US005433005A

United States Patent [19]

Cogdill et al.

[11] Patent Number: 5,433,005

[45] Date of Patent: Jul. 18, 1995

[54] CHIPPING HAMMER

[76] Inventors: Sean D. Cogdill, P.O. Box 1955; Clyde Kranenberg, 2400 Bush La., both of Mills, Wyo. 82644

[21] Appl. No.: 266,366

[22] Filed: Jun. 27, 1994

[51] Int. Cl.[6] ..... E21C 37/26

[52] U.S. Cl. ..... 30/164.7; 30/167; 30/168

[58] Field of Search ..... 30/167, 167.1, 167.2, 30/168, 164.5, 164.6; 173/129, 130; 74/582; 403/13, 14, 354, 359, 378

[56] References Cited

U.S. PATENT DOCUMENTS

| | | | |
|---|---|---|---|
| 926,346 | 6/1909 | Mann | 30/164.6 |
| 1,093,830 | 4/1914 | Cook | 30/168 |
| 1,424,221 | 8/1922 | Trumpeter | 30/164.6 |
| 1,437,425 | 12/1922 | Keeler | 30/164.6 |
| 1,451,102 | 4/1923 | Neale | 30/167 |
| 5,157,807 | 10/1992 | Keller et al. | 16/116 |

*Primary Examiner*—Richard K. Seidel
*Assistant Examiner*—Jay A. Stelacone
*Attorney, Agent, or Firm*—Daryl C. Josephson; Kevin A. Sembrat

[57] ABSTRACT

A hammer and chisel device for clearing slag from welds includes a chipping chisel interchangeably and springingly affixed within a weighted handle having a slip resistant grip. Since welds often produce slag in a hard to reach spot, the invention provides for repeated one handed slag removal. A sturdy chisel with a resilient cutting surface is replaceably received by the handle utilizing a releasable retaining washer and retaining ring. A spring within the handle returns the chisel shank to an extended position, thereby providing for repeatable hammer-like blows to the chisel shank by the handle. The handle or striking rod includes a chisel shank guide receiving track for consistent sequential strikes without axial rotation. A molded slip resistant grip minimizes necessary grip pressure and prevents hand slippage. Heavy construction provides sufficient force for quick, one handed operation. A slim design provides for easy handling and use in harder to reach places.

9 Claims, 4 Drawing Sheets

CHIPPING HAMMER

BACKGROUND OF THE INVENTION

1. Field of Invention

This invention relates generally to welding tools and more specifically to welding tools for the chipping away of slag left as a result of the welding process.

2. Description of Prior Art

Waste material, commonly referred to in the welding industry as slag, is typically produced proximate to a weld as a byproduct of the welding process. This slag must be removed quickly, with minimal interruption to the welder and without causing damage to the surfaces surrounding the weld.

One common method for removing slag from a weld area is a two-handed chipping and scraping operation utilizing a hammer and chisel. The welder repeatedly aligns the chisel blade abutting a given section of often thick and strongly adhering slag and strikes the chisel head with the hammer.

This hammer and chisel method presents numerous disadvantages. First, the two-handed operation requires repeated exchange of tools and welder repositioning, thereby decreasing welder productivity. Second, inevitable chisel blade slippage and inaccurate blade realignment, again inherent in a two-handed operation, often causes damage to the weld site and surrounding surfaces. Third, welds often extend into obstructed areas necessarily thwarting hammer and chisel access; this is further aggravated by welder left or right handedness. Fourth, the shock from inordinately repeated blows due to the inherent inefficiency of this method causes unnecessary shock to the welder's hands and other body parts.

A second method, utilized either alternatively or in conjunction with a hammer and chisel, involves the use of a conventional chipping hammer. Having a long handle and a curved head with a pick end and a chisel end, the chipping hammer is swung at the weld site, again in an attempt to chip away at the slag.

The inherent disadvantages of swinging a weighted object (the hammer) and hoping to effectively strike a small target are also numerous. Actually connecting with and clearing the slag without damaging the surrounding surfaces is unlikely, even assuming a high degree of skill. Obstructed areas often cannot be accessed due to the arcing motion of the hammer. Control is extremely limited given the force of the blow required to remove slag. Left or right handedness often limits or even prevents effectiveness. Damage to the welder's hands due to repetitive blows necessitated by the inefficiency of this method, as with a hammer and chisel, is inevitable.

Thus there is a need for a slag removal tool that does not require two-handed operation, is not thwarted by common slag positioning, is less affected by handedness and reduces hand and bodily damage due to excessive striking. Such a tool must further minimize repositioning of the tool such that slag is effectively removed without damage to the welding site is also minimized.

SUMMARY OF THE INVENTION

The object of the invention is to provide a slag removal tool that is easily adapted to by welders and provides for greater slag removal productivity while minimizing damage to the welding site and/or welder.

In accordance with the present invention, this object is achieved with a slim, yet durable and weighty striking handle with an integral, springingly telescoping, interchangeable chisel. For this purpose, the Chipping Hammer according to the invention further provides a striking handle with a contoured inner surface for guiding the chisel in a consistently longitudinal direction and devoid of axial rotation. The invention, having sufficient driving weight, a familiar and reliably directed chipping device and a means for accurate, spring assisted repetitive strikes, thus provides a means for productive, one-handed removal of slag without causing chisel slippage or other related damage.

DETAILED DESCRIPTION OF THE PREFERRED EMBODIMENT

Figure 1:
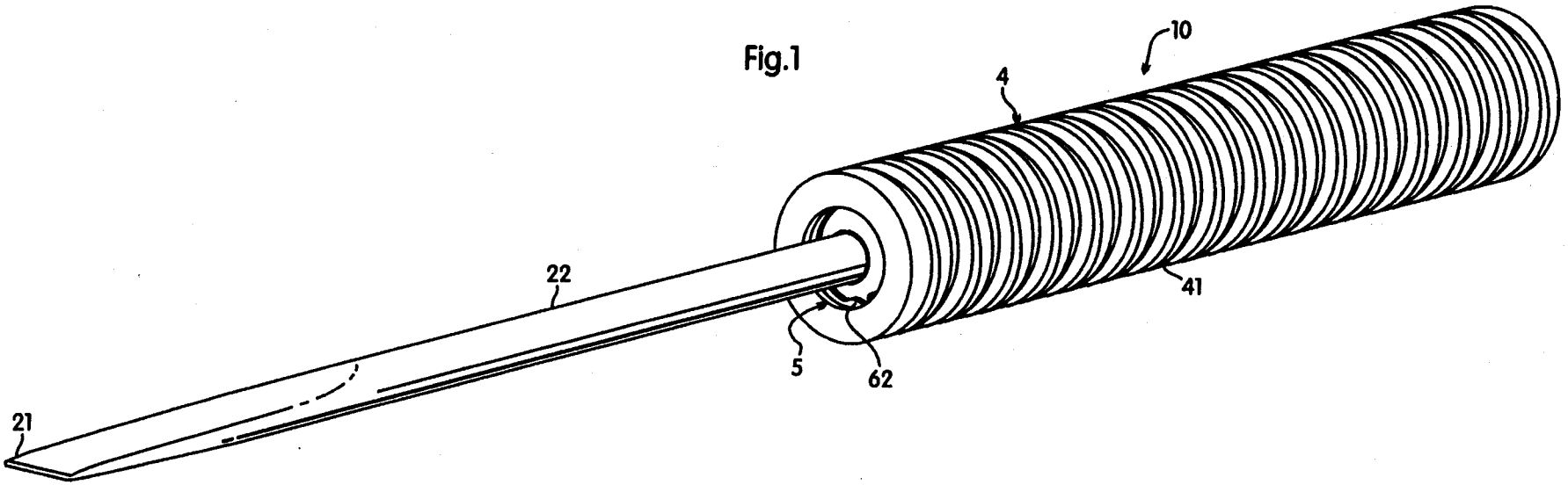
FIG. 1 is a front perspective view of the Chipping Hammer showing the chisel shank extending from the driving handle.
Figure 2:
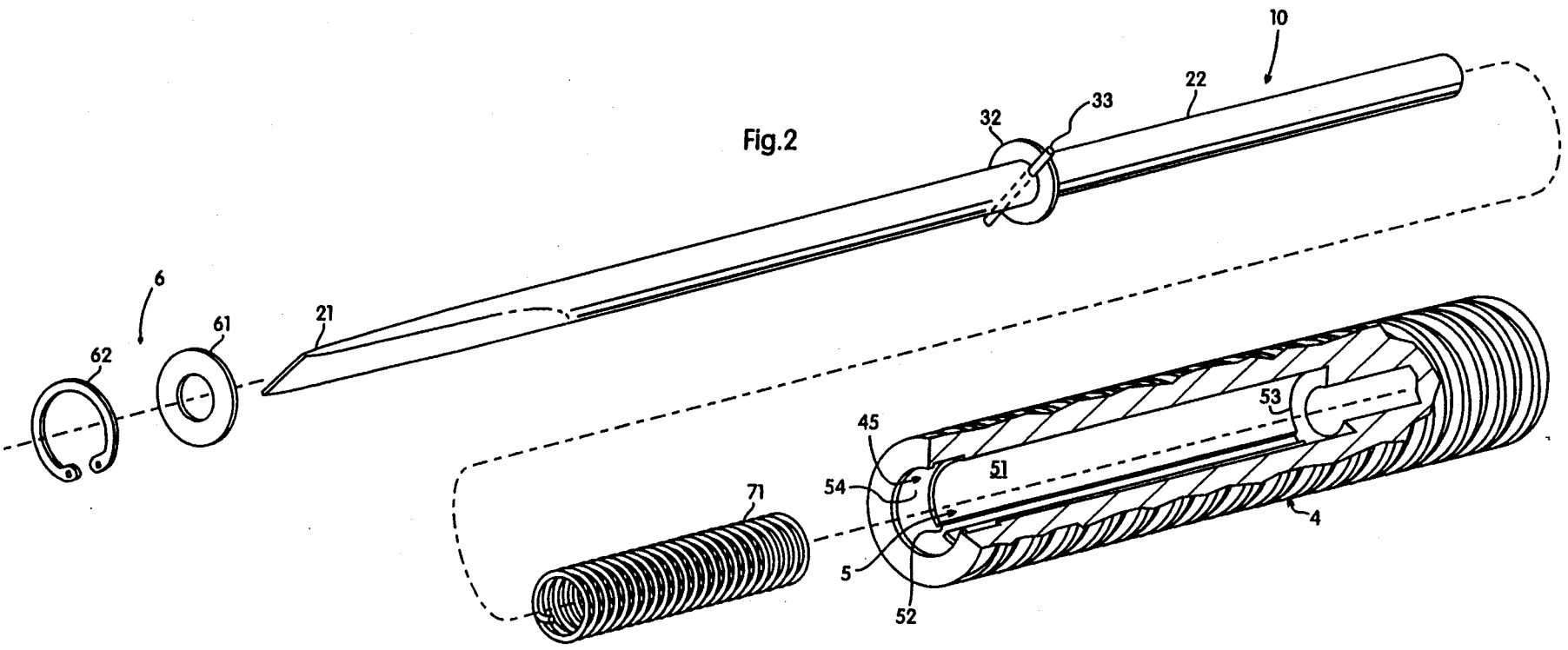
FIG. 2 is an exploded partial cutaway view thereof showing how the chisel and integral chisel guide are springingly received by and locked into the driving handle.

Referring to the drawings, FIGS. 1 and 2 detail the construction of the Chipping Hammer 1 while FIGS. 3 and 4 detail its operation.

FIG. 1 shows how the Chipping Hammer 1 is intended as a stand alone tool that can be used with one hand to remove slag from welds in an easily adaptable, one-handed manner. The Chipping Hammer 10 includes a shank 22 having a chisel end 21, wherein the shank 22 is removably mounted within a weighty driving handle 4 through the use of a retaining ring 62. The slim, elongated handle 4 provides handle grooves 41 such that an easy grip is sufficient to prevent a welder's hand from slipping, even when working on hard to reach welds and despite one-handed operation. In addition, the handle cavity 5 is essentially cylindrical for receiving the shank 22 telescopingly. Both the shank 22 and handle 4 are composed of steel, the shank 22 being a higher carbon alloy for durability.

FIG. 2 details how a shank 22 augmentation, a tooled handle cavity 5 and a locking means 6 provide for a reliably repetitive, telescoping shank 22 motion. The shaft 22 is augmented with a guide washer 32 and a guide pin 33. The position of the guide washer 32 along the shank 22 is such that the handle cavity 5 extends beyond the end of the shank 22 after assembly. This allows the shank 22 to move telescopingly within the handle cavity 5. The guide washer 32 moves slidingly along the cavity walls 51, preventing lateral movement of the shank 22. The guide pin 33 extends beyond the cavity walls 51 into guide tracks 52 formed within the cavity 5, thereby preventing axial rotation of the shank 22.

FIG. 2 further shows how a retaining means 6 prevents the shank 22 from unintentionally separating entirely from the driving handle 4. A retaining washer 61 is seated within a retaining groove 54 formed proximate to the mouth 45 of the handle cavity 5. The retaining washer 61 provides additional surface area and strength to a retaining ring 62 which is compressed and similarly placed within the retaining groove 54 as well as providing for additional lateral movement prevention. The retaining washer 61 is the same diameter as mouth 45, preferably 1 inch, whereas retaining groove 54 has a diameter larger than the mouth 45, preferably 1.06 inches, thereby to form retaining groove 54 for receiving the conventional retaining ring 62, which ring 62 is tensioned outwardly against the retaining groove 54, and wherein the retaining ring 62 is inserted through the mouth 45 by gripping the ring 62 with conventional retaining ring pliers (not shown), which pliers squeeze the ring together to temporarily decrease the tensioned diameter of the ring to be inserted within the mouth 45.

Finally, FIG. 2 shows how a spring 71 has been added such that the shank 22 is automatically extended outward from the driving handle 4 following each hammering motion by the user through recoiling of the spring 71. When the chisel end 21 encounters a surface, the shank 22 is moved deeper inside the handle cavity 5. This forces the guide pin 33 against the spring 71. Since spring movement is prevented by a stopping shelf 53 within the handle cavity 5, the spring 71 is compressed. As the surface is removed, either through surface or driving handle 4 movement, the spring 71 recoils, extending the shank 22 outward.

Figure 4A:
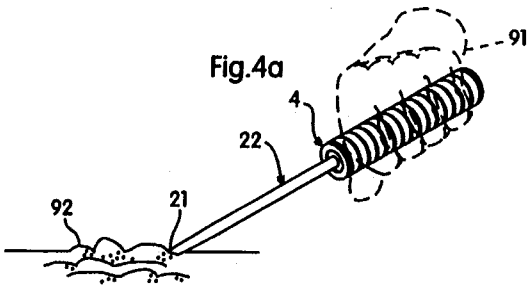
FIG. 4*a* is a perspective view thereof showing how the chisel blade is placed abutting welding slag.
Figure 4B:
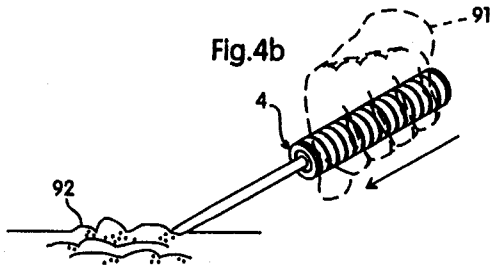
FIG. 4*b* is a perspective view as in FIG. 4*a* showing how the driving handle is driven forward to loosen welding slag.
Figure 4C:
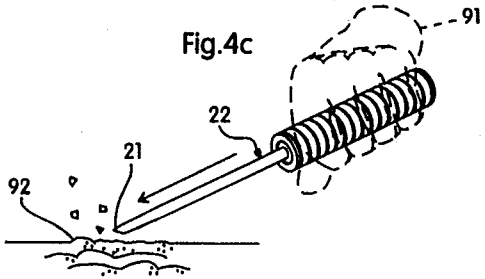
FIG. 4*c* is a perspective view as in FIG. 4*b* showing how the recoiling spring forces the blade forward thereby scraping away welding slag.
Figure 3A:
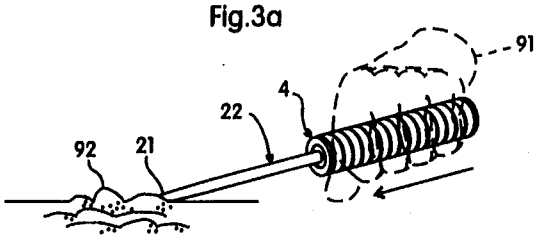
FIG. 3*a* is a perspective view thereof showing how the chisel blade is placed abutting welding slag and the driving handle is driven forward.
Figure 3B:
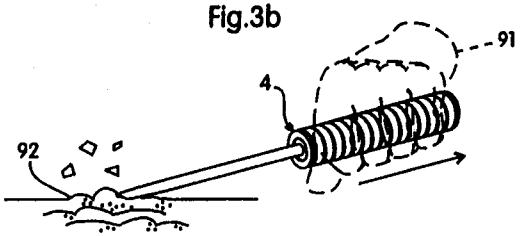
FIG. 3*b* is a perspective view as in FIG. 3*a* showing how the chisel blade remains abutting the welding slag as the driving handle is withdrawn.
Figure 3C:
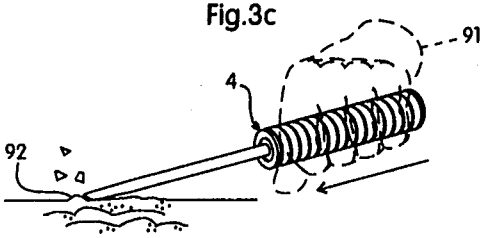
FIG. 3*c* is a perspective view as in FIG. 3*b* showing how welding slag is chipped away by further thrusts of the driving handle.

As shown in FIG. 3*a* through 3*c* and 4*a* through 4*c*, the recoiling action of the spring 71 also provides for one handed slag removal. With the chisel end 21 abutting thick slag 92, as shown in FIG. 3*a*, the driving handle 4 can be moved abruptly forward and backward by a user's hand 91 for repeated hammer like blows as shown in FIG. 3*a*. The chisel end 21, held in place by the expanding spring 71, transfers these blows to the slag 92 in the form of a chipping action (FIG. 3*c*). Alternatively, as shown in FIG. 4*a*, less troublesome slag loosened by an initial blow will be removed without additional handle 4 movement based upon sufficient shank 22 extension due to the recoiling spring 71 (FIGS. 4*a* through 4*c*).

While the above description contains many specificities, these should not be construed as limitations on the scope of the invention, but rather as an example of the preferred embodiment thereof. Many other variations are possible.

For example, the guide washer 32 and guide pin 33 serve as an augmentation to the chisel shank 22 for the purpose of aligning the shank 22 when received by the handle cavity 5 for repeatable blows. This purpose can also readily be achieved using a tooled or molded guide of similar shape. Further, the shape of the guide can also vary in any number of ways as long as the guide tracks 52 within the handle cavity 5 are appropriately matched to receive the guide in a functionally effective manner.

Another example is that rubber or other shock absorbing material can be added to the handle grooves 41 on the outer surface of the driving handle 4, preferably as a conventional handgrip.

A third example is that the retaining ring 62 and retaining washer 61 can similarly be replaced with a single, specially designed releasingly retaining device. Again, the overall functionality and proper matching of the receiving cavity, in this case the retaining groove 54, is retained despite the use conventional form, fit and function replacements.

Figure 5:
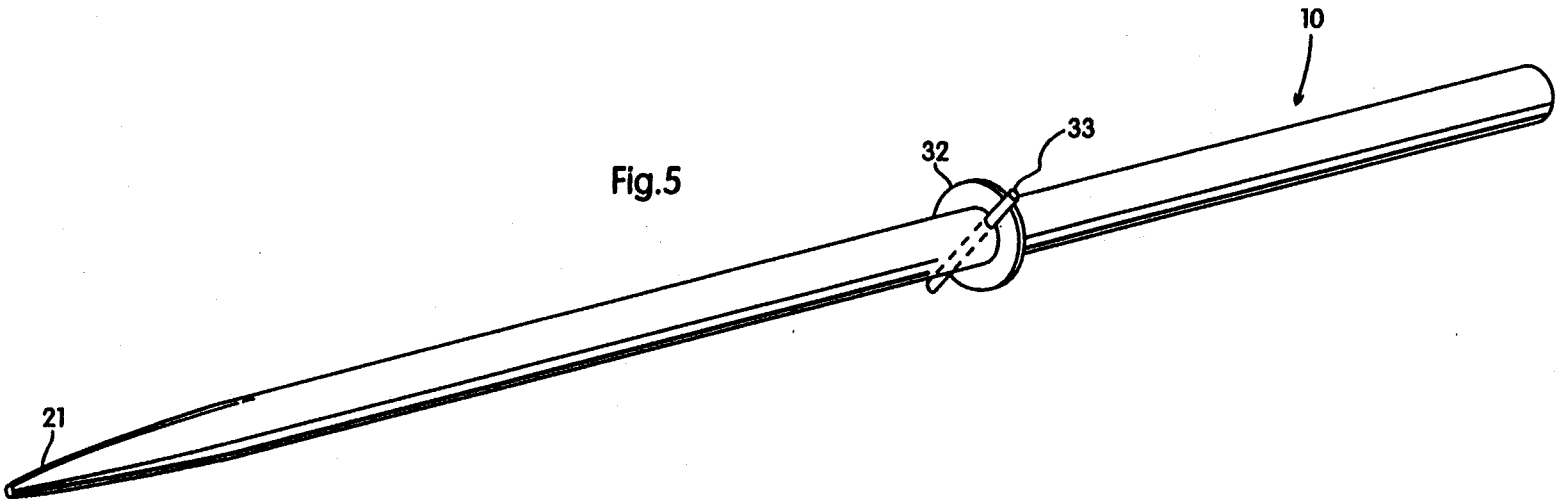
FIG. 5 is a perspective view of an interchangeable slag removal means in the form of a shank with a hardened point at the chisel end, according to a preferred embodiment of the present invention.
Figure 6:
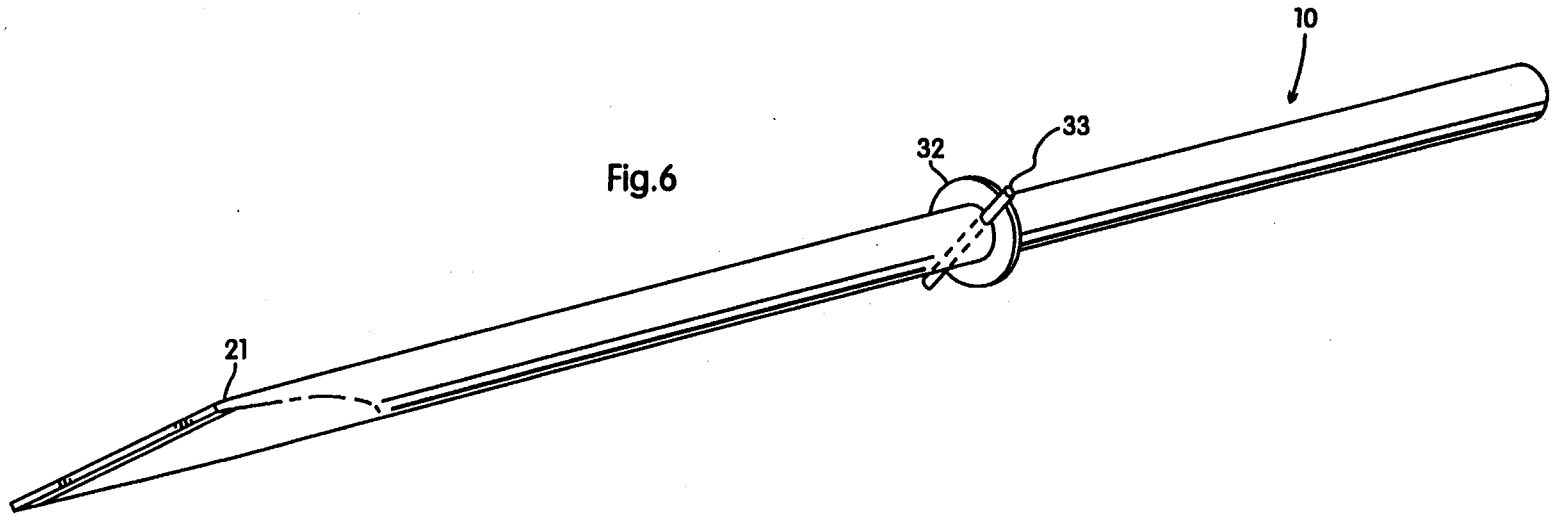
FIG. 6 is a perspective view of an interchangeable slag removal means in the form of a shank with a hardened point at the chisel end, according to a preferred embodiment of the invention.

Finally, the use of a retaining ring 62 or other locking device is specifically intended to allow the easy replacement of worn chisels as well as interchangability of the shank 22 with other needed devices. Such devices include, but are certainly not limited to, a shank 22 with a pick end, similar in function to that of a conventional chipping hammer. Included also is welding and slag removal means with a different end for different applications to remove slag, for instance, a hardened point such as an awl, or an angled edge. (See FIGS. 5 and 6).

Other embodiments are, of course, anticipated by and clearly fall within the scope of the present invention.

I claim:

1. A chipping hammer comprising:

a shank having a chisel end and a shank butt end, wherein the chisel end is driven into welding slag for chipping away and scraping away the slag;

guide means for guiding said shank longitudinally without axial rotation, extending radially from said shank;

a tubular, elongated and driving handle having a mouth end, a handle butt end, an inner surface and an outer surface, for interchangeably and telescopingly receiving said shank and driving said shank for slag removal, also for receiving the guide means whereby lateral and rotational movement of said shank due to impact of said chisel end of said shank is prevented;

a spring received by the driving handle whereby said spring is compressed due to driving of said shank by said weighted driving handle, and recoiling of said spring extends said shank longitudinally from said weighted driving handle; and retaining means received by and releasingly affixed within said driving handle for preventing said shank and said spring from becoming unintentionally detached from within said weighted driving handle.

2. A chipping hammer comprising:

a shank having a chisel end and a shank butt end, wherein the chisel end is driven into welding slag for chipping away and scraping away the slag;

guide means for guiding said shank longitudinally without axial rotation, extending radially from said shank;

an elongated and weighted driving handle having a mouth end, a handle butt end and side walls, said side walls having an outer surface and an inner surface, said inner surface defining a cylindrical cavity extending from said mouth end to said handle butt end for receiving said guide means, thereby telescopingly receiving said shank while preventing lateral movement of said shank, the inner surface also defining a narrow track for further receiving said guide means and thereby preventing rotation of said shank;

an elongated spring received within said cylindrical cavity of said driving handle between said handle butt end of said driving handle and said guide means whereby said spring is compressed by said guide means due to driving of said shank, and recoiling of said spring extends said shank longitudinally from said weighted driving handle; and retaining means received by and releasingly affixed within said weighted driving handle for preventing said guide means and therefore said shank and said spring from becoming unintentionally removed from within said weighted driving handle.

3. A chipping hammer comprising:

a shank having a chisel end and a shank butt end, wherein the chisel end is driven into welding slag for chipping away and scraping away the slag;

a guide affixed to and extending radially from said shank said guide comprising a disc portion for guiding said shank longitudinally without lateral movement and a plurality of integral peg-like protrusions for guiding said shank longitudinally without axial rotation;

an elongated and weighted driving handle having a mouth end, a handle butt end and side walls, said side walls having an outer surface and an inner surface, said inner surface defining a cylindrical retaining cavity proximate to said mouth end, said inner surface also defining a cylindrical cavity, a plurality of tracks, a shelf and a shank guide, the cylindrical cavity abutting said retaining cavity and extending to said shelf for receiving said disc portion of said guide, said plurality of tracks also abutting retaining cavity and extending to said shelf for receiving said peg-like protrusions of said guide, said guide extending from said shelf to said handle butt end, said weighted driving handle thereby telescopingly receiving said shank while preventing lateral movement and rotation of said shank;

an elongated spring received within said cylindrical cavity of said inner surface of said driving handle, positioned around said shank between said guide and said shelf of said weighted driving handle, whereby said spring is compressed by said guide due to driving of said shank, and recoiling of said spring extends said shank longitudinally from said weighted driving handle such that repeated one-handed pumping of said weighted driving handle, with said chisel end of said shank placed against said welding slag, causes said chisel end of said shank to chip away said welding slag, and a singular driving movement of said weighted driving handle causes said chisel end of said shank to scrape away said welding slag; and a retaining ring and a retaining washer received by and releasingly affixed within said retaining cavity of said weighted driving handle for preventing said guide and therefore said shank and said spring from becoming unintentionally removed from within said weighted driving handle.

4. A chipping hammer as defined in claims 2 or 3, wherein said outer surface of said weighted driving handle further defines an elongated conventional hand grip proximate to said handle butt end of said weighted driving handle.

5. A chipping handle as defined in claim 4 further comprising a hand grip cover for dampening shock due to driving of said shank.

6. A chipping handle as defined in claim 5 wherein said shank is composed of a high carbon steel and said weighted driving handle is composed of steel.

7. A chipping hammer as defined in claims 1, 2 or 3, wherein said shank is chosen from a group comprising a plurality of welding and slag removal means wherein said plurality of welding and slag removal means are interchangeable with said weighted driving handle.

8. A chipping hammer as defined in claim 7, wherein said group comprising a plurality of welding and slag removal means consists of chisels, picks and punches.

9. A chipping hammer as defined in claim 1, wherein said outer surface of said weighted driving handle further defines an elongated conventional hand grip proximate to said handle butt end of said weighted driving handle.

* * * * *